US006388370B1

(12) United States Patent
Ohmae

(10) Patent No.: US 6,388,370 B1
(45) Date of Patent: May 14, 2002

(54) CATHODE RAY TUBE

(75) Inventor: Hideharu Ohmae, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/613,736

(22) Filed: Jul. 11, 2000

(30) Foreign Application Priority Data

Jul. 15, 1999 (JP) ..... 11-202230

(51) Int. Cl.[7] ..... H01J 29/07
(52) U.S. Cl. ..... 313/403; 313/407
(58) Field of Search ..... 313/402, 403, 313/407, 408

(56) References Cited

U.S. PATENT DOCUMENTS 4,926,089 A * 5/1990 Moore ..... 313/403
5,583,391 A * 12/1996 Good et al. ..... 313/403
5,856,725 A 1/1999 Ueda
6,124,668 A * 9/2000 Shoda ..... 313/403

FOREIGN PATENT DOCUMENTS

| | | |
|---|---|---|
| EP | 0 487 106 | 5/1992 |
| GB | 2 351 600 | 1/2001 |
| JP | 1-320738 | 12/1989 |
| JP | 9-265916 | 10/1997 |

* cited by examiner

*Primary Examiner*—Ashok Patel
(74) *Attorney, Agent, or Firm*—Merchant & Gould PC

(57) ABSTRACT

A cathode ray tube capable of reducing a doming amount and suppressing an occurrence of moire stripes by providing protruding portions in a slot aperture of a tension type shadow mask. In a cathode ray tube including a mask frame formed in the form of a frame, and a shadow mask made of a flat plate containing a plurality of slot apertures, which is stretched and held onto the mask frame with a tension force applied in the longitudinal direction of the apertures, the shadow mask is provided with bridges linking the slot apertures arranged neighboring in the longitudinal direction, and the slot aperture is provided with protruding portions facing each other and protruding from the both ends in the lateral direction of the slot aperture into the inside of the slot aperture. Thus, it is possible to reduce the doming amount and to suppress an occurrence of moire stripes, while securing the mechanical strength and luminous intensity.

9 Claims, 7 Drawing Sheets

CATHODE RAY TUBE

FIELD OF THE INVENTION

The present invention relates to a cathode ray tube having a shadow mask, which is used for a television receiver, a computer display, and the like.

BACKGROUND OF THE INVENTION

FIG. 3 is a cross-sectional view showing one example of a conventional color cathode ray tube. The color cathode ray tube 1 shown in FIG. 3 includes a substantially rectangular-shaped face panel 2 having a phosphor screen on its inner face, a funnel 3 connected to the rear side of the face panel 2, an electron gun 4 contained in a neck portion 3*a* of the funnel 3, a shadow mask 6 facing a phosphor screen 2*a* inside the face panel 2, and a mask frame 7 for fixing the shadow mask 6. Furthermore, in order to deflect and scan electron beams, a deflection yoke 5 is provided on the outer periphery of the funnel 3.

The shadow mask 6 plays a role of selecting colors with respect to three electron beams emitted from the electron gun 4. "A" shows a track of the electron beams. Hereinafter, this shadow mask 6 is referred to as a slot type shadow mask. The slot type shadow mask has a flat plate provided with a number of slot apertures by etching. The slot aperture is a substantially rectangular-shaped through aperture through which electron beams pass.

In a color cathode ray tube, due to the thermal expansion caused by absorbing electron beams, the electron beam through aperture is deformed. Consequently, a doming phenomenon occurs. That is, the electron beams passing through the electron beam through apertures fail to hit a predetermined phosphor correctly, thus causing unevenness in colors. Therefore, a tension force to absorb the thermal expansion due to the temperature increase of the shadow mask is applied in advance, and then the shadow mask is stretched and held to the mask frame. Thus, when stretching and holding the shadow mask as mentioned above, even if the temperature of the shadow mask is increased, it is possible to reduce the amount of displacement between a slot aperture of the shadow mask and phosphor strips of the phosphor screen.

FIG. 5 is a plan view showing a slot type shadow mask as an example of the shadow mask to which a tension force is applied mainly in the vertical direction of the screen. The direction illustrated by the arrow x is a horizontal direction of the screen, and the direction illustrated by the arrow y is a vertical direction of the screen. The slot apertures 8 are formed at constant pitches. Reference numeral 9 is referred to as a bridge, which is a portion between slot apertures 8. The bridge width has an effect on the mechanical strength of the shadow mask. More specifically, a narrower bridge width weakens the tension particularly in the horizontal direction. If the bridge width is increased in order to improve the mechanical strength, the aperture area of the slot aperture is reduced, thus deteriorating the luminance intensity.

Furthermore, the bridge width is related to the mechanical strength and luminance intensity, and the longitudinal pitch of the bridge also is related to the doming amount of the shadow mask. The shadow mask is stretched mainly in the longitudinal direction. This is because the thermal expansion in the longitudinal direction is absorbed by the tension force, while the thermal expansion in the lateral direction is transmitted in the lateral direction through the bridge.

FIG. 4 is a graph showing one example of the relationship between the bridge pitch and the doming amount (an example of a cathode ray tube for a 25-inch television is shown). FIG. 4 shows that the doming amount can be reduced as the bridge pitch is increased.

However, the conventional color cathode ray tube suffers from the following problem. When the longitudinal pitch of the bridge is increased, the doming amount can be reduced and the luminance intensity also is improved by the increase of the aperture area of the slot aperture. However, in this case, moire stripes easily occur, thus causing the deterioration of the image quality. The moire stripe means a mutual interference stripe between scanning lines (luminescent lines) of the electron beams arranged at constant intervals and the regular pattern of the electron beam through apertures of the shadow mask.

Furthermore, when the longitudinal pitch of the bridge is increased, the bridges themselves may appear as dots on the screen, or may be recognized as a pattern in which the bridges are piled up (a brick-like pattern).

On the contrary, when the bridge pitch is reduced, moire stripes are suppressed sufficiently and the bridges themselves are not noticeable. In this case, however, the shielded area of the scanning line is increased, and the luminance intensity is lowered, and the doming amount is also increased. In other words, it was difficult both to reduce the doming amount and to suppress the occurrence of moire stripes at the same time.

SUMMARY OF THE INVENTION

It is an object of the present invention to provide a cathode ray tube capable of reducing the doming amount and suppressing the occurrence of moire stripes at the same time by forming protruding portions facing each other inside the slot aperture in the tension style shadow mask.

According to the present invention, a cathode ray tube includes a mask frame formed in the form of a frame, and a shadow mask made of a flat plate containing a plurality of slot apertures, which is stretched and held onto the mask frame with a tension force applied in the longitudinal direction of the slot apertures, wherein the shadow mask has bridges linking the slot apertures arranged neighboring in the longitudinal direction, and the slot aperture has protruding portions facing each other and protruding from the both ends of the lateral direction of the slot aperture to the inside of the slot aperture. According to such a cathode ray tube, it is possible to reduce the doming amount due to the thermal expansion while suppressing the occurrence of moire stripes.

It is preferable in the above-mentioned cathode ray tube that the bridges and the protruding portions in the slot aperture line are displaced from the bridges and protruding portions in the neighboring slot aperture line, and the displacing amount is in the range from 1/2 to 1/5 with respect to the longitudinal pitch of the slot aperture. According to such a preferred cathode ray tube, it is possible to suppress the occurrence of moire stripes and also to suppress an occurrence of moire stripes in the oblique direction, which is caused by the displacement of bridges in the longitudinal direction, so that they are not observed significantly.

It is preferable that the protruding portions are arranged at the longitudinal pitch of 1 mm or less in the slot aperture, and the longitudinal pitch of the bridge is in the range from 1.5 to 30 mm. If the longitudinal pitch of the protruding portion is 1 mm or less, even in the case of a plural broadcasting method, it is possible to suppress an occurrence of moire stripes for each broadcasting by using one shadow mask structure. Furthermore, by setting the longitudinal pitch of the bridge in the range from 1.5 mm to 30 mm, it is possible to reduce the doming amount so as to be below a certain value, and to suppress the vibration of the shadow mask to fall within a practical level while securing a certain level of the luminous property and the mechanical strength.

Furthermore, it is preferable that the area of a pair of protruding portions arranged neighboring in the lateral direction of the slot aperture is in the range from 20% to 120% with respect to the area of one bridge. According to such a preferred cathode ray tube, it is possible to suppress the occurrence of moire stripes, while securing the luminous property.

Furthermore, it is preferable that the longitudinal pitch of the protruding portion differs in different parts of the shadow mask. With such a preferred configuration, it is possible to suppress an occurrence of moire stripes effectively in accordance with the part in the shadow mask where the moire stripes tend to occur.

Furthermore, it is preferable that the longitudinal pitch of the bridge differs in different parts of the shadow mask. With such a preferred configuration, the strength and the amount of heat transmission can be changed in accordance with the part in the shadow mask.

Furthermore, it is preferable that the width of the bridge in the longitudinal direction differs in different parts of the shadow mask. With such a preferred configuration, it is possible to change the strength of the bridge as needed, by taking into account the tension distribution of the shadow mask.

Furthermore, it is preferable that the width of the protruding portion in the longitudinal direction differs with the part in the shadow mask. With such a preferred configuration, the effect of shielding light beams by the protruding portions can be changed in accordance with the beam incident angle, to obtain the luminance intensity.

According to another aspect of the present invention, a cathode ray tube of the present invention includes a mask frame formed in the form of a frame, and a shadow mask made of a flat plate containing a plurality of slot apertures, which is stretched and held onto the mask frame with a tension force applied in the longitudinal direction of the slot apertures, wherein the shadow mask has bridges linking the slot apertures arranged neighboring in the longitudinal direction, the length of the slot aperture in the longitudinal direction is longer than the length in the central portion, and the slot aperture in the peripheral portion has protruding portions facing each other and protruding from the both ends of the lateral direction of the apertures to the inside of the slot aperture. Thus, in the central portion providing the reference tension force, the strength of the shadow mask can be secured while suppressing the thermal doming that tends to occur in the peripheral portion.

DETAILED DESCRIPTION OF THE INVENTION

Figure 3:
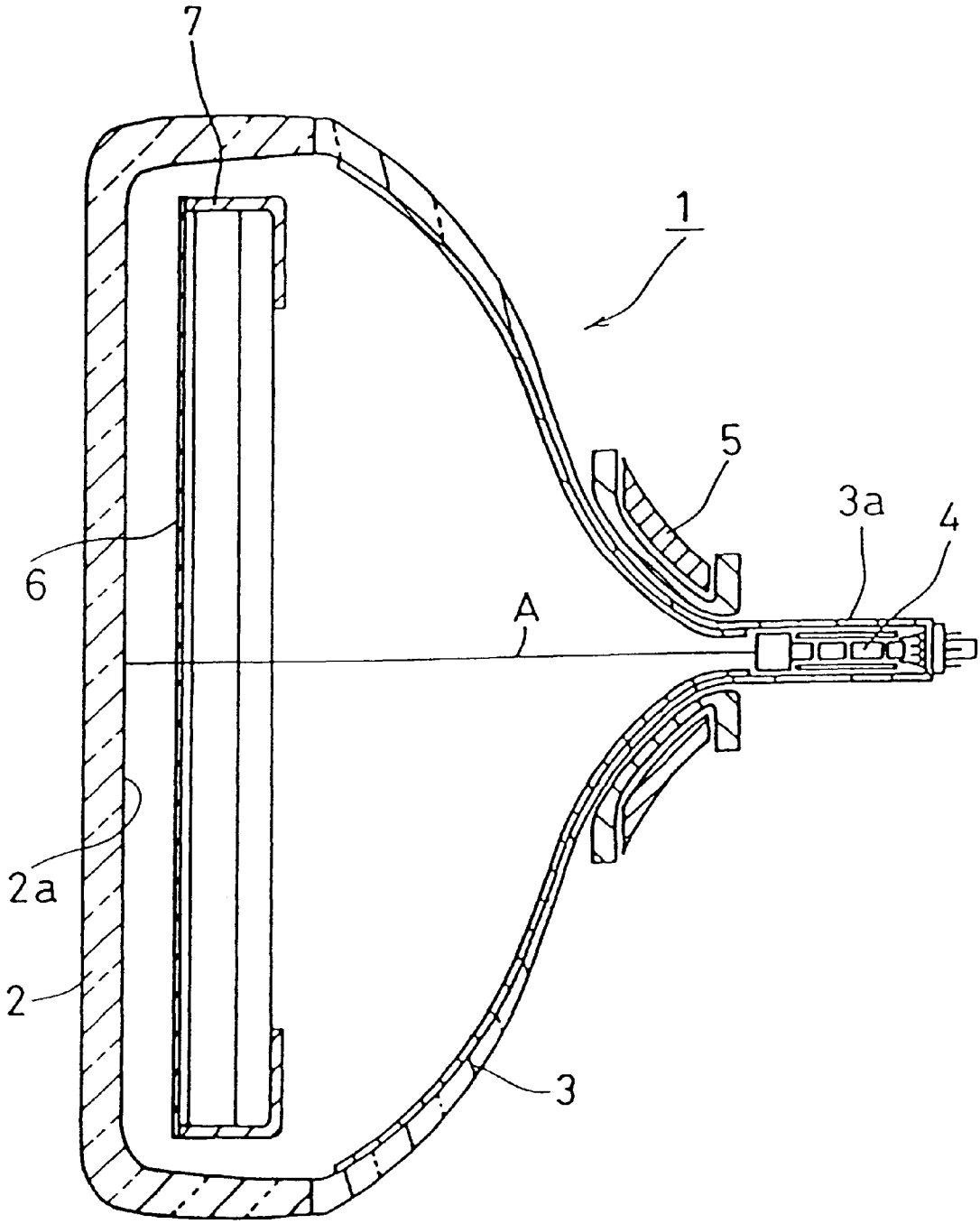
FIG. 3 PRIOR ART
FIG. 3 is a cross-sectional view showing an example of a conventional color cathode ray tube.

Hereinafter, the present invention will be described by way of an embodiment with reference to drawings. Since each constitution of the color cathode ray tube described with reference to FIG. 3 is similar to the constitutions of this embodiment, the explanations thereof are not repeated herein.

Figure 1A:
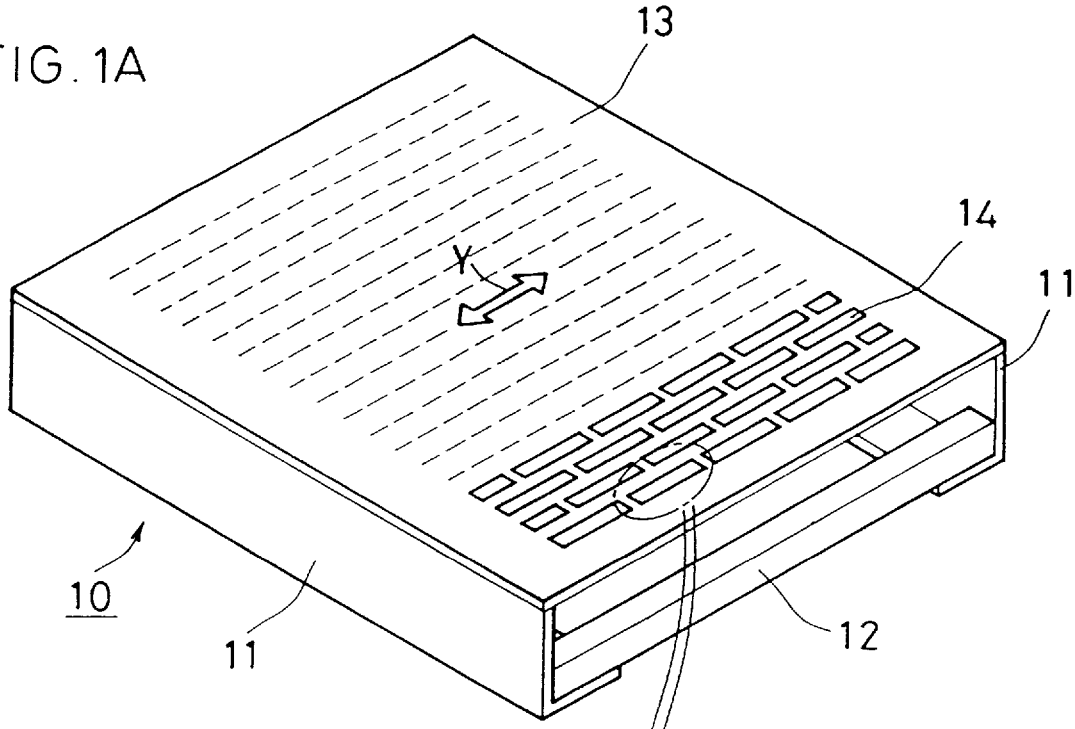
FIG. 1 is a perspective view showing a color-selecting electrode of one embodiment according to the present invention.
Figure 1B:
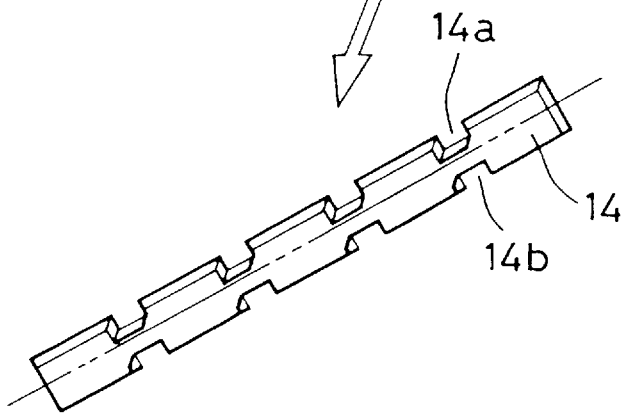

FIG. 1A is a perspective view showing a color-selecting electrode of one embodiment according to the present invention. A mask frame 10 is a rectangular frame and is made of a pair of long frame supports 11, facing each other, fixed to a pair of short frames made of elastic members 12. On the shadow mask 13, a plurality of slot apertures 14, which are substantially rectangular-shaped slot type electron beam through apertures, are formed by etching. In FIG. 1A, a tension method is employed, the shadow mask 13 is stretched and held between the supports 11 with a tension force applied mainly in the direction illustrated by arrow Y. FIG. 1B is an enlarged view of the slot aperture 14. The slot aperture 14 is provided with protruding portions 14*a* and 14*b*, which are not shown in FIG. 1A.

Figure 6:
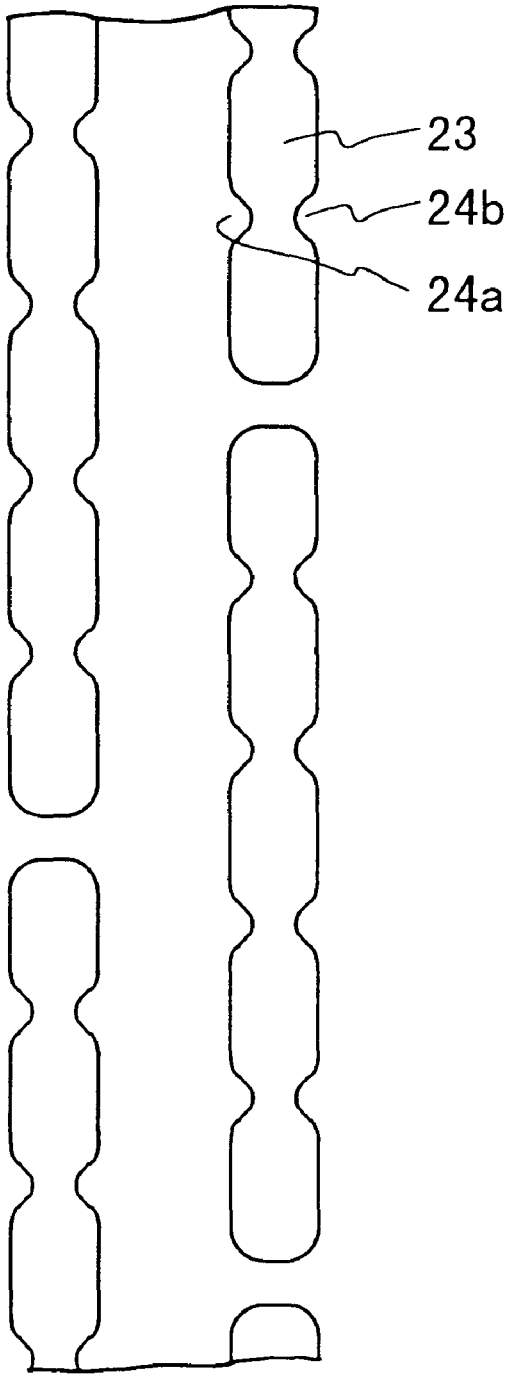
FIG. 6 is a plan view showing a slot aperture and a protruding portion of one embodiment according to the present invention.
Figure 7:
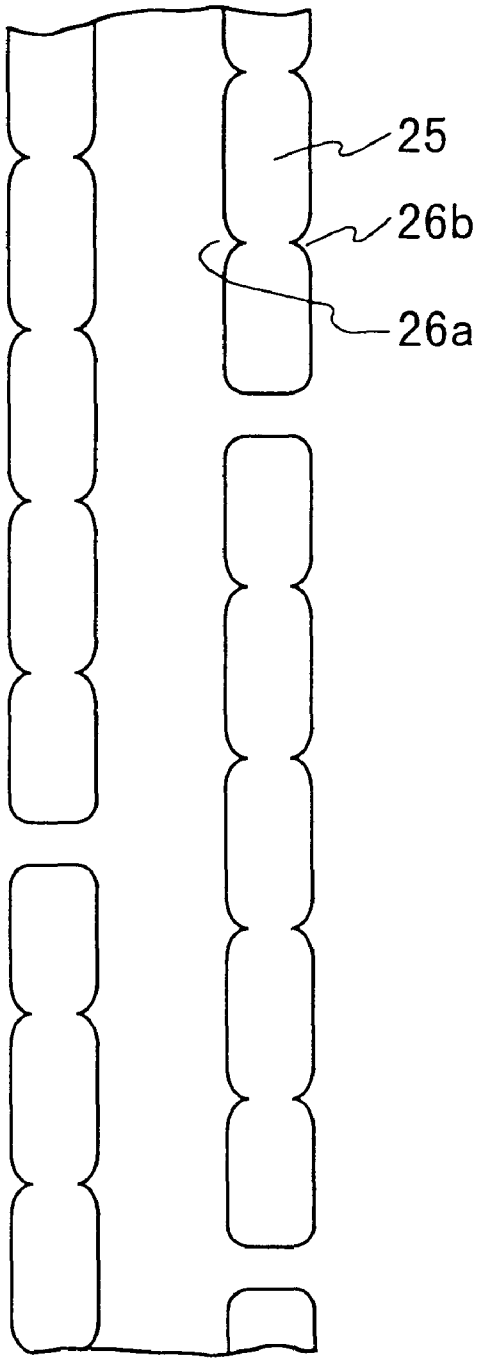
FIG. 7 is a plan view showing a slot aperture and a protruding portion of another embodiment according to the present invention.

In FIG. 1B, the shapes of the slot aperture 14 and the protruding portions 14*a* and 14*b* are rectangular, but there is no limitation to this shape. For example, as shown in FIG. 6, the slot aperture 23 and protruding portions 24*a* and 24*b* may have round corners. Furthermore, as shown in FIG. 7, protruding portions 26*a* and 26*b* of slot apertures 25 may protrude gradually. In particular, the shape shown in FIG. 7 easily can be realized by an etching method that mainly is used when producing shadow masks. Thus, it is practical. The protruding portions will be explained in detail later.

Figure 2A:
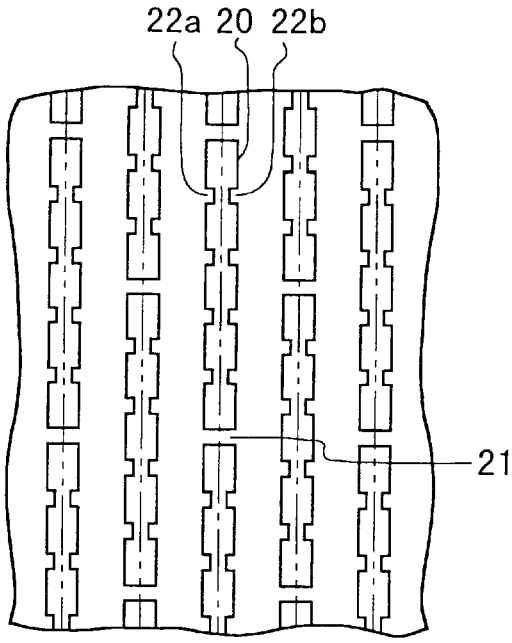
FIG. 2 is a plan view showing a slot type shadow mask of one embodiment according to the present invention.
Figure 2B:
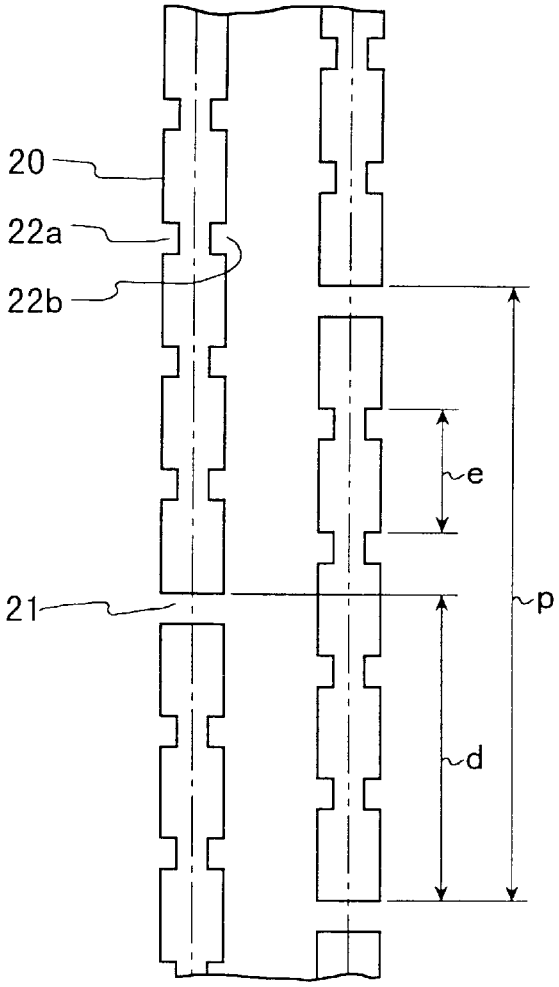

FIG. 2 is a plan view of a slot type shadow mask of one embodiment. FIG. 2B is a partially enlarged view of FIG. 2A. The longitudinal direction of the view is a vertical direction of the screen, and the lateral direction of the view is a horizontal direction of the screen. The neighboring slot apertures 20 arranged in the longitudinal direction are linked by the bridge 21. In the slot aperture 20, the protruding portions 22*a* and 22*b* are formed. These protruding portions 22*a* and 22*b* are protruded from the both ends in the lateral direction of the slot aperture 20. The tips of the protruding portions 22*a* and 22*b* are facing each other. These pairs of protruding portions 22*a* and 22*b* are formed so that the slot apertures 20 are narrowed.

Figure 4:
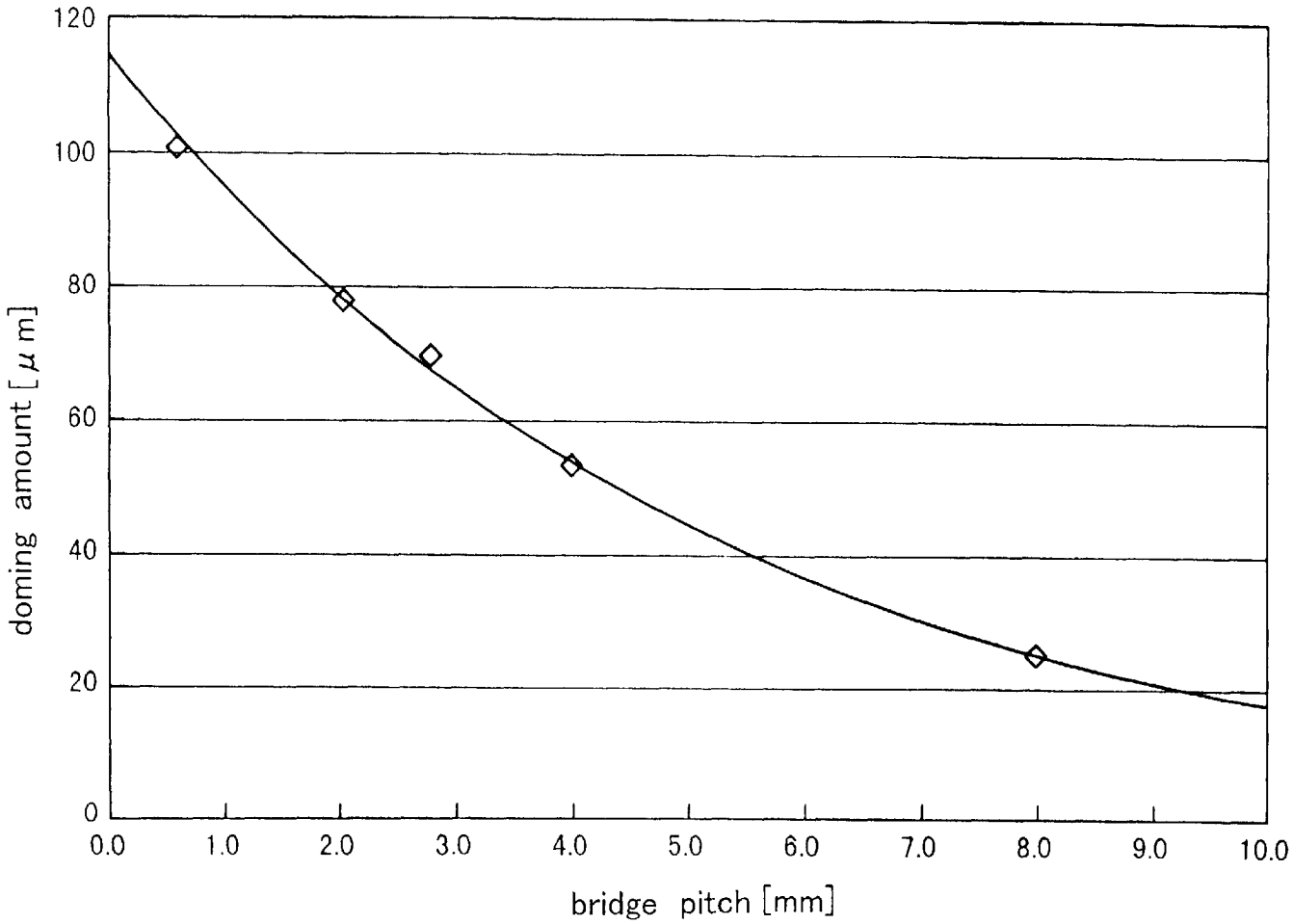
FIG. 4 PRIOR ART
FIG. 4 is a graph showing an example of the relationship between the bridge pitch and the doming amount.
Figure 5:
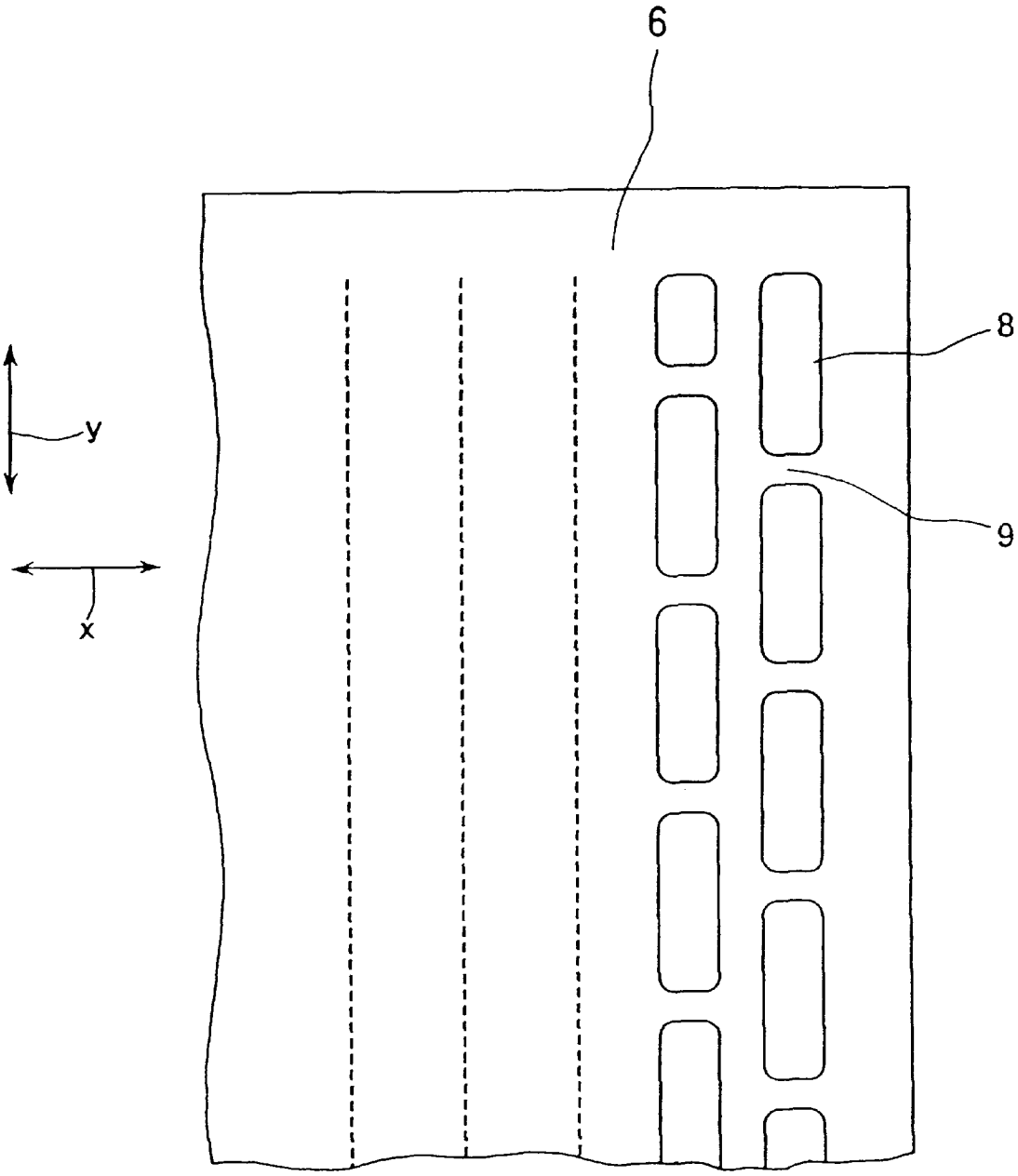
FIG. 5 PRIOR ART
FIG. 5 is a plan view showing an example of a conventional slot type shadow mask.

With such a shadow mask of this embodiment, it is possible to suppress the occurrence of moire stripes while reducing the doming amount due to the thermal expansion particularly in the lateral direction. The reason for this will be described in detail hereinafter. FIG. 4 is a graph showing the relationship between the longitudinal pitch of the bridge and the doming amount. FIG. 4 shows that when the longitudinal pitch of the bridge is increased, it is possible to reduce the doming amount. Furthermore, when the longitudinal pitch of the bridge is increased, the aperture area of the slot aperture also is increased, thus improving the luminance intensity.

In this case, however, the increase in the bridge pitch may lead to the occurrence of moire stripes. Therefore, in order to suppress the occurrence of moire stripes, it is necessary to reduce the bridge pitch.

Furthermore, for example, if the area of the bridge is reduced in order to suppress the lowering of the luminance intensity, the mechanical strength is reduced, and the bridge may be torn due to the stress in the lateral direction accompanying the stress in the longitudinal direction.

A pair of the protruding portions 22*a* and 22*b* solve this problem. By providing the protruding portions 22*a* and 22*b*, it is possible to obtain an effect of substantially cutting scanning lines. Furthermore, since the protruding portion 22*a* is separate from the protruding portion 22*b*, and not only the longitudinal stress but also the lateral stress accompanying the longitudinal stress is not applied, and thus no problems occur in terms of the mechanical strength.

Furthermore, the protruding portions 22*a* and 22*b* do not completely close the slot apertures in the lateral direction. Moreover, as mentioned above, since the stress is not applied to the protruding portions mask as mentioned above. Therefore, for example, the width in the longitudinal direction may be reduced. Also in this case, the lowering of the luminance intensity can be suppressed. That is, according to this embodiment, it is possible to reduce the doming amount of the shadow mask to which a tension force is applied mainly in the longitudinal direction and to suppress the occurrence of moire stripes, while securing the mechanical strength and luminous intensity.

Furthermore, in order to suppress an occurrence of moire stripes, it is preferable that the bridges and protruding portions are shifted with respect to those of the neighboring slot aperture lines in the lateral direction. With such a shifting, since it is possible to suppress the mutual interference between the scanning line and slot aperture pattern, it is more effective to suppress the occurrence of moire stripes. As the shifting amount d in the lateral direction between the bridges in the neighboring lines (FIG. 2) is small, the length between the bridges arranged neighboring on the same horizontal line is increased. Consequently, it is effective to suppress an occurrence of the moire stripes on the horizontal direction. However, if the shifting amount becomes too small, the moire stripes in the oblique direction are observed remarkably. Therefore, it is preferable that the shifting amount d is in the range from 1/2 to 1/5 with respect to the longitudinal pitch P of the slot aperture 20 (the longitudinal pitch of the bridge 21).

It is preferable that the longitudinal pitch e of the protruding portions 22*a* and 22*b* is 1 mm or less, and the longitudinal pitch P of the slot aperture 20 is in the range from 1.5 to 30 mm. The following is a reason of this.

In the cathode ray tube without having protruding portions in the slot aperture, the following equation is satisfied:

$\lambda=1/(n/2s-s/a)$, wherein "$\lambda$" is a wavelength of moire, "a" denotes a longitudinal pitch of the bridge, "s" denotes an interval between the scanning lines; and "n" denotes a mode order of moire.

In the case of a plural broadcasting method, in order to suppress an occurrence of moire stripes by one shadow mask structure with respect to each broadcasting system, a compromise value of s/a is 9/8 for NTSC, and 11/8 for PAL. Therefore, if the longitudinal pitch a of the bridge is 1 mm or less, even in the case of the plural broadcasting method, it is possible to find a solution for suppressing the occurrence of moire stripes in one shadow mask.

That is, if the longitudinal pitch a of the bridge is replaced by the longitudinal pitch e of the protruding portions 22*a* and 22*b* of the present invention, it is preferable that the longitudinal pitch e is 1 mm or less in order to suppress the occurrence of moire stripes.

Furthermore, as shown in FIG. 4, as long as the longitudinal pitch P of the slot aperture 20 is in the above-mentioned range, the doming amount can be reduced so as to be about 90 $\mu$m or less. Furthermore, it is possible to suppress the vibration of the shadow mask within the practical range, while securing a certain luminance intensity and mechanical strength.

That is, if the longitudinal pitch P is too small, the doming amount is increased and the luminance intensity cannot be secured. On the contrary, if the longitudinal pitch P is too large, although the doming amount is small, the mechanical strength becomes insufficient and the vibration also is increased. In the above-mentioned range, the vibration can be suppressed to the level of the conventional press mask produced by the press molding.

Furthermore, it is preferable that the area of a pair of protruding portions 22*a* and 22*b* corresponds to 20–120% of the area of one bridge 21. The reason why the area is in the above-mentioned range, if the area of the protruding portion is too small with respect to the bridge, it is not possible to suppress an occurrence of moire stripes sufficiently. On the contrary, if the area is too large, the luminance intensity is lowered.

Furthermore, it is preferable that the longitudinal pitch of the protruding portion differs with the part or region in the shadow mask. For example, the longitudinal pitch of the protruding portion can be set to be fine in the peripheral portion where moire stripes tend to occur, and on the other hand, the longitudinal pitch of the protruding portion can be set to be longer in the central portion that is hardly affected by moire stripes.

Furthermore, it is preferable that the longitudinal pitch of the bridge differs with the part or region in the shadow mask.

For example, the longitudinal pitch P of the bridge as illustrated in FIG. 2B may be about 15 mm in the central portion of the shadow mask and about 5 to 10 mm in the end portion in the lateral direction. Thus, in the peripheral portion in the lateral direction on which the stress to the bridge tends to be concentrated due to the difference in the strength between a region without apertures and a region with apertures, it is possible to prevent the shadow mask from being broken by reducing the stress applied to the bridge.

As another example, the longitudinal pitch of the bridge may be about 5 to 10 mm in the central portion, and 10 to 15 mm in the peripheral portion in the lateral direction so as to change the longitudinal pitch gradually. Thus, it is possible to suppress the thermal doming amount in the lateral direction of the mask, which tends to be accumulated in the peripheral portion in the lateral direction. In this case, since the number of the bridges in the peripheral portion in the lateral direction is reduced, the strength tends to be insufficient. However, by setting the width in the longitudinal direction of the bridge in the peripheral portion, it is possible to reduce the stress applied to the bridge and to prevent the shadow mask from being bent or torn.

Furthermore, the configuration combining these two structures may be employed. In other words, the value of the longitudinal pitch of the bridge is gradually increased from the central portion toward the peripheral portion in the lateral direction, and the value is reduced again in the vicinity of the ends of the lateral direction. Thus, it is possible to suppress the thermal doming amount and to prevent the shadow mask from being broken due to the difference in the strength between the region without apertures and the region with apertures.

Furthermore, it is preferable that the width of the protruding portion in the longitudinal direction differs with the part or region in the shadow mask. The electron beams entering the shadow mask have different incident angles in accordance with the part in the shadow mask. In particular, since in the peripheral portion of the shadow mask, the incident angle is acute, the rate at which the electron beam is shielded by the bridges or the protruding portions is increased and the luminance intensity tends to be lowered. However, in the peripheral portion, the electron beams are shielded by the influence of not only the width of the bridge but also the thickness of the shadow mask. By reducing the width of the protruding portion in the longitudinal direction in the peripheral portion, it is possible to improve the luminance intensity in the peripheral portion.

Furthermore, the protruding portion may be provided only in the peripheral portion without providing the central portion of the shadow mask. For example, in the central portion of the shadow mask, generally rectangular-shaped apertures and bridges are provided; and toward the peripheral portion of the shadow mask, the longitudinal pitch of the bridges is increased gradually and the length of the apertures in the longitudinal direction is increased, as well as the protruding portion is provided in the aperture with the number of the protruding portions increased. Thus, in the central portion that serves as a standard portion where a tension force is applied, the strength of the shadow mask can be secured while suppressing the thermal doming that tends to occur in the peripheral portion. In this case, the longitudinal pitch of the bridge in the peripheral portion of the shadow mask is increased, and thus the strength in the peripheral portion may be insufficient. It is possible to solve this problem by setting the longitudinal width of the bridge to be wide so as to loosen the stress of the bridge.

In this embodiment, the protruding portions 22*a* and 22*b* are formed separately and arranged facing each other at their tips, which provides another effect that a geomagnetism characteristic is improved, in addition to the effect mentioned above.

The following is an explanation of the geomagnetism characteristic. The cathode ray tube is shielded against the magnetic field from the outside by using a component such as a magnetic shield, or the like, in order that electron beams are not diverted significantly from the regular track. The magnetic characteristic generally means that the electron beams are affected by the geomagnetism, thus causing the misalignment of colors. The shadow mask capable of selecting colors plays a role of improving the geomagnetic characteristic by shielding the magnetism from the outside. In particular, the geomagnetism moving to the panel of the cathode ray tube substantially vertically is allowed to flow in the surface direction of the shadow mask, whereby the geomagnetism is prevented from directly affecting the electron beams.

In the shadow mask without having a protruding portion in the slot, when the bridge pitch of the shadow mask is large, the geomagnetism easily flows in the vertical direction of the shadow mask. However, since a few bridges are present, the geomagnetism does not easily flow in the horizontal direction. Therefore, particularly in the peripheral portion in which the frame and shadow mask are approaching to each other, the geomagnetism remaining in the shadow mask occasionally floats in the direction of the inside of the tube. Furthermore, the area of the slot aperture is large, the geomagnetism directly passes through the slot aperture so often, whereby the track of electron beams is changed thus to cause the misalignment of colors.

On the other hand, in this embodiment, by providing protruding portions facing and approaching to each other in the slot aperture, the protruding portions facing each other (for example, 22*a* and 22*b* in FIG. 2B) play a role of submitting the geomagnetism to each other. Therefore, in addition to the flow of the geomagnetism in the vertical direction, the geomagnetism also flows in not only in the bridge portion but also in the protruding portion. Consequently, the geomagnetism does not float, and furthermore, the effect of picking up the geomagnetism passing through the slot aperture at the protruding portion is exhibited. Therefore, the electron beams are not adversely affected by the geomagnetism. Consequently, it is possible to obtain a cathode ray tube with less misalignment of colors due to the geomagnetism.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A cathode ray tube comprising a mask frame formed in the form of a frame, and a shadow mask made of a flat plate containing a plurality of slot apertures, which is stretched and held onto the mask frame with a tension force applied in the longitudinal direction of the slot apertures, wherein the shadow mask has bridges linking the slot apertures arranged neighboring in the longitudinal direction, and the slot aperture has protruding portions facing each other and protruding from the both ends of the lateral direction of the slot aperture to the inside of the slot aperture.

2. The cathode ray tube according to claim 1, wherein the bridges and the protruding portions in the slot aperture line are displaced in the longitudinal direction from the bridges and protruding portions in the neighboring slot aperture line, and the displacing amount is in the range from 1/2 to 1/5 with respect to the longitudinal pitch of the slot aperture.

3. The cathode ray tube according to claim 1, wherein the protruding portions are arranged at the longitudinal pitch of 1 mm or less in the slot aperture, and the longitudinal pitch of the bridge is in the range from 1.5 mm to 30 mm.

4. The cathode ray tube according to claim 1, wherein the area of a pair of protruding portions arranged neighboring in the lateral direction of the slot aperture is in the range from 20% to 120% with respect to the area of one bridge.

5. The cathode ray tube according to claim 1, wherein the longitudinal pitch of the protruding portion differs in different parts of the shadow mask.

6. The cathode ray tube according to claim 1, wherein the longitudinal pitch of the bridge differs in different parts of the shadow mask.

7. The cathode ray tube according to claim 1, wherein the width of the bridge in the longitudinal direction differs in different parts of the shadow mask.

8. The cathode ray tube according to claim 1, wherein the width of the protruding portion in the longitudinal direction differs in different parts of the shadow mask.

9. A cathode ray tube comprising a mask frame formed in the form of a frame, and a shadow mask made of a flat plate containing a plurality of slot apertures, which is stretched and held onto the mask frame with a tension force applied in the longitudinal direction of the slot apertures, wherein the shadow mask has bridges linking the apertures arranged neighboring in the longitudinal direction, the length of the aperture in the longitudinal direction is longer than the length in the central portion, and the slot aperture in the peripheral portion has protruding portions facing each other and protruding from the both ends of the lateral direction of the slot aperture to the inside of the slot aperture.

* * * * *